US008365569B2

(12) United States Patent
Frauchiger

(10) Patent No.: US 8,365,569 B2
(45) Date of Patent: Feb. 5, 2013

(54) METHOD AND TOOL FOR THE PRODUCTION OF THREE-DIMENSIONAL ATTACHMENTS BY FORMING AND FINE BLANKING OPERATIONS

(75) Inventor: Paul Frauchiger, Cincinnati, OH (US)

(73) Assignee: Feintool Intellectual Property AG, Lyss (CH)

( * ) Notice: Subject to any disclaimer, the term of this patent is extended or adjusted under 35 U.S.C. 154(b) by 1025 days.

(21) Appl. No.: 11/591,390

(22) Filed: Oct. 31, 2006

(65) Prior Publication Data

US 2008/0053181 A1 Mar. 6, 2008

(51) Int. Cl.
*B21D 28/00* (2006.01)
*B21D 31/02* (2006.01)
*B21J 11/00* (2006.01)

(52) U.S. Cl. ..... 72/336; 72/337; 72/329; 72/324; 72/340; 72/404

(58) Field of Classification Search ..... 72/336–337, 72/404, 405.01, 329, 330, 338, 341, 340, 72/324; 29/893.33–893.34
See application file for complete search history.

(56) References Cited

U.S. PATENT DOCUMENTS

| | | | | |
|---|---|---|---|---|
| 4,275,924 | A | 6/1981 | Lehmann et al. | |
| 4,567,746 | A * | 2/1986 | Bachmann et al. | 72/336 |
| 4,573,739 | A | 3/1986 | Schottker | |
| 4,923,041 | A | 5/1990 | Stockmar | |
| 5,398,408 | A * | 3/1995 | Bernet | 29/893.33 |

(Continued)

FOREIGN PATENT DOCUMENTS

| | | |
|---|---|---|
| DE | 1192887 | 5/1965 |
| DE | 2834492 | 2/1980 |

(Continued)

OTHER PUBLICATIONS

2007 "Umformen und Feinschneiden" R.-A. Schmidt et al. Hanser pp. 144-173.

*Primary Examiner* — Dana Ross
*Assistant Examiner* — Mohammad I Yusuf
(74) *Attorney, Agent, or Firm* — Jordan and Hamburg LLP

(57) ABSTRACT

A method and tool for the production of three-dimensional attachments out of a flat strip by forming and fine blanking operations, especially for car seat components or the like. The flat strip is fed into a tool, at least one plate is stamped out of the plate in the tool, the plate is processed into an attachment in multiple processing steps, at first by fine blanking, in a following second step the developed burrs are flattened and then without finishing the attachment is removed from the tool ready for mounting. Attachments with complex geometry can be produced by combined fine blanking and forming operations in such a way, that mountable and burr-free parts with very small tolerances, high accuracy and process safety can be provided at effective costs. Simultaneous forming and fine blanking of the plate is carried out in the first process stage, wherein the plate is completely cut out of the flat strip and the position, form and location of the inner form created by the forming during the complete cutting out is aligned to the outer contour of the plate, and in the second stage, by centering the plate before flattening the burr, which developed during fine blanking at the outer and inner contours, according to its outer contour and simultaneously orienting the plate according to location and form of the shape of the inner form created in the plate in such a way, that the burr at the fine blanked surfaces can be flattened directly in the tool.

12 Claims, 5 Drawing Sheets

U.S. PATENT DOCUMENTS

| | | | | |
|---|---|---|---|---|
| 6,212,930 | B1 | 4/2001 | Skrabs et al. | |
| 6,427,512 | B2 * | 8/2002 | Suzuki et al. | 72/337 |
| 6,453,716 | B2 * | 9/2002 | Suzuki | 72/329 |
| 6,526,798 | B2 * | 3/2003 | Suzuki | 72/330 |
| 6,904,782 | B2 * | 6/2005 | Suzuki | 72/337 |
| 6,951,124 | B2 * | 10/2005 | Kanamaru et al. | 72/336 |
| 7,178,375 | B2 * | 2/2007 | Badour | 72/336 |

FOREIGN PATENT DOCUMENTS

| | | | |
|---|---|---|---|
| DE | 3227222 | | 5/1984 |
| DE | 3244399 | | 6/1984 |
| DE | 3630981 | | 3/1987 |
| EP | 0885074 | | 12/1998 |
| JP | 2001-246428 | * | 9/2011 |

* cited by examiner

METHOD AND TOOL FOR THE PRODUCTION OF THREE-DIMENSIONAL ATTACHMENTS BY FORMING AND FINE BLANKING OPERATIONS

BACKGROUND OF THE INVENTION

The invention relates to a method for the production of three-dimensional attachments out of a flat strip by forming and fine blanking operations, especially attachments provided with formed parts inside such as projections and/or indentations and/or impressions and/or recesses and/or sinks and/or holes and/or pivots, especially for car seat components or the like, wherein the flat strip is fed into a tool, at least one plate with a substantially evenly curved outline is stamped out of the flat strip in the tool, the plate is processed into an attachment in multiple processing steps, at first by fine blanking, in a following second step the developed burrs are flattened and then, without finishing, the attachment is removed from the tool ready for mounting.

Furthermore, the invention relates to a tool for the production of three-dimensional attachments out of flat strips provided with formed parts inside, such as projections and/or indentations and/or impressions and/or recesses and/or sinks and/or holes and/or pivots, especially for car seat components or the like through combined forming and fine blanking processes with a tool for forming and fine blanking, a tool for flattening the burrs which developed at the inner and outer contours during fine blanking, and a transfer device for transporting the attachments between the tools.

Conventional seat adjustment components, for example fixed and swivelling hinge parts of hinge attachments, are produced by forming, fine blanking or stamping with the necessary high dimensional accuracy based upon final intended use. These hinge parts have inner or outer toothings for the transmission of rotational movements, which are formed in one piece together with the respective hinge part as projections (DE 32 44 399 C2, DE 28 34 492 C2, DE 32 27 222 C1).

EP 0 885 074 B1 discloses a method for the production of stampings, especially plates, in two operation steps. In a first operation step, the work part in a device is cut out of the starting material by fine blanking. After fine blanking, the work part is brought to the embossing stage by transfer tongs (accommodated in the device), wherein the embossing stage is also accommodated in the device. In a second operation step, the outer and inner contours of the work part are formed, so that the burrs developed at the work part during the first operation step are flattened to an extend that the work piece does not require further finishing.

Plates are disk shaped and have openings mostly in the form of slits, which are open towards the edge of the disk, or long holes (see DE 36 30 981 A1). Alternatively, they are closed disks having shafts projecting in an axial direction (DE 11 92 887). Plates without requirements with regard to tolerance do not make high demands on fine blanking processes and the portion of forming operations as drawing, bending, bending off, upsetting, cranking, surfacing, embossing, hobbing, making projections and indentations, extrusion or pressing pivots is not worth mentioning.

Regularly, attachments of car seat adjustments are provided with complex inner structures or contours such as projections, indentations, impressions, recesses, sinks, holes or pressed pivots, which place very high demands on forming and fine blanking processes with regard to the material, as well as to the design.

The limitations of fine blanking of portions with small corner radii in relation to the thickness of the sheet to be cut and to the quality of the material are sufficiently known. Based on experience, a fine blanking severity is defined which distinguishes the severity degrees S1 (easy), S2 (medium) and S3 (difficult) (see "Forming and fine blanking", a handbook on cold pressing, material properties, component design, pages 154 to 165, Verlag Hallwag AG, 1997, Switzerland). Thus the severity degree is essentially defined by the cutting path geometry and the thickness of the metal sheet. For this, the cutting path geometry is divided into simple geometric basic areas such as corner radii, hole diameters, groove and fin widths. From the ratio between a geometric dimension and the thickness of the metal sheet results the severity degree of fine blanking, which grows with growing metal sheet thickness. This means that fine blanking of large-surface thin parts, as in the case of plates, is substantially easier than the fine blanking of small webs or rings in the case of large thickness of metal sheets. Also, obtuse-angled corners with big radii are to be cut better than sharp-cornered parts with small radii.

Due to the characteristic high portion of forming operations in connection with hinge attachments and their relatively large thickness, the state of the art according to EP 0 885 074 B1 is not transferable, because the necessary knowledge of the flow characteristics of the materials, the hardness and the stability of the extrusion ram under load, the coating, the lubricant and the design of the tool, is not available.

Furthermore, the state of the art according to EP 0 885 074 B1 has the disadvantage that the plates are only partially cut from the flat strip and thus in several points stay connected to the flat strip. Due to the different geometries in the flat strip eccentric loads occur, leading to a displacement of the strip, and thus to the impairment of the tolerances of the processed part, which is not acceptable for safety parts such as seat adjustment components. Furthermore, the disadvantage also exists in that due to the subsequent internal cut of the plate, still at some points connected to the flat strip, the circularity is heavily reduced, so that substantial deviations of tolerances may occur.

In view of this state of the art, it is a object of the invention to improve a method and a tool for producing attachments with complex geometry by combined fine blanking and forming operations in such a way that mountable and burr-free parts with very small tolerances, high accuracy and process safety can be provided at effective costs.

SUMMARY OF THE INVENTION

This object is fulfilled by a method of the kind discussed above, wherein, in a first step at least one plate is stamped out of a flat strip by fine blanking while simultaneously forming the at least one plate in a tool into which the flat strip is fed, such that the at least one plate is completely cut out of the flat strip with at least an outer contour. The forming operation creates at least one inner form, a position, form and location of which is aligned to a position of the outer contour of the at least one plate. In a second step, any burrs which may have developed at least at outer contour during cutting out of the flat strip are flattened after the at least one plate is centered according to the outer contour and simultaneously oriented according to the location of the at least one inner form which was formed into the at least one plate, such that the burrs of the fine blanked surfaces can be flattened directly in the tool.

In accordance with the invention, the fine blanking and the forming of complex hinge attachments can be realized in one common first process stage. By aligning the position, form and position of the inner form of the hinge attachment created by forming, to the position or dimension of the outer contour of the plate, it is possible to combine the forming process with the fine blanking process in one single process stage. This provides the extraordinary advantage that the attachments are completely cut out of the flat strip, then are taken up and afterwards can be cut at the inside without the possibility of displacing the parts by the flat strip and without a distortion reducing the circularity of the parts. This improves the safety of the process and the accuracy.

Before flattening the burr which developed during cutting the plate out of the flat strip, the plate is centered according to its outer contour and simultaneously oriented according to the position and the shape of inner forms, which were formed into the inner side of the plate, guaranteeing the exact positioning for the flattening.

The method according to the invention makes it possible to produce finished, mountable hinge attachments with high accuracy and very small tolerances in only two process steps without finishing, wherein the position and location of the inner contours are aligned to the position of the outer contour of the plate during complete cutting out, and the plate, before flattening the burr which developed at the inner and outer contours during cutting out of the flat strip, is centered according to its outer contour in the second step, and is simultaneously oriented according to the location of the inner form, which was formed into the plate.

A further advantage is that the finished hinge attachments can be taken out of the tool without damage, because several first process steps (stages) are carried out on the flat strip simultaneously in a feed direction of the flat strip, but offset from each other of successive places, and the cut out plates are removed from the second stage contradirectionally to each other.

The tool according to this invention realizes all fine blanking and stamp processes as well as forming operations during one passage of the flat strip. The modular design of the tool allows uncoupling of the different simultaneously executed fine blanking from each other, stamping and forming processes per press stroke, whereby it becomes possible to align the single modules in such a way, that the flat strip is evenly loaded. This consequently leads to a more economical production of the hinge attachments.

Further advantages and details result from the following description with reference to the enclosed drawings.

DETAILED DESCRIPTION OF THE INVENTION

Figure 1:
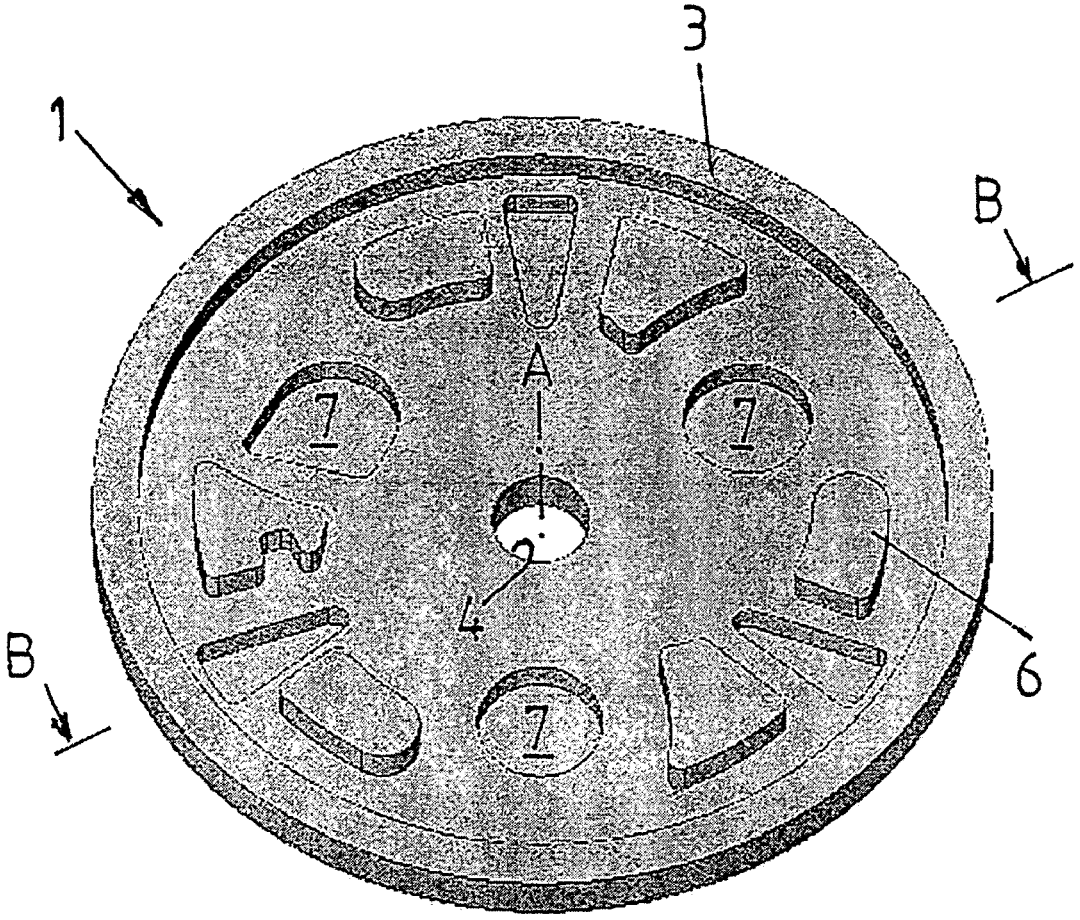
FIG. 1 is a perspective view of a common hinge attachment produced according to the method of the invention.
Figure 2:
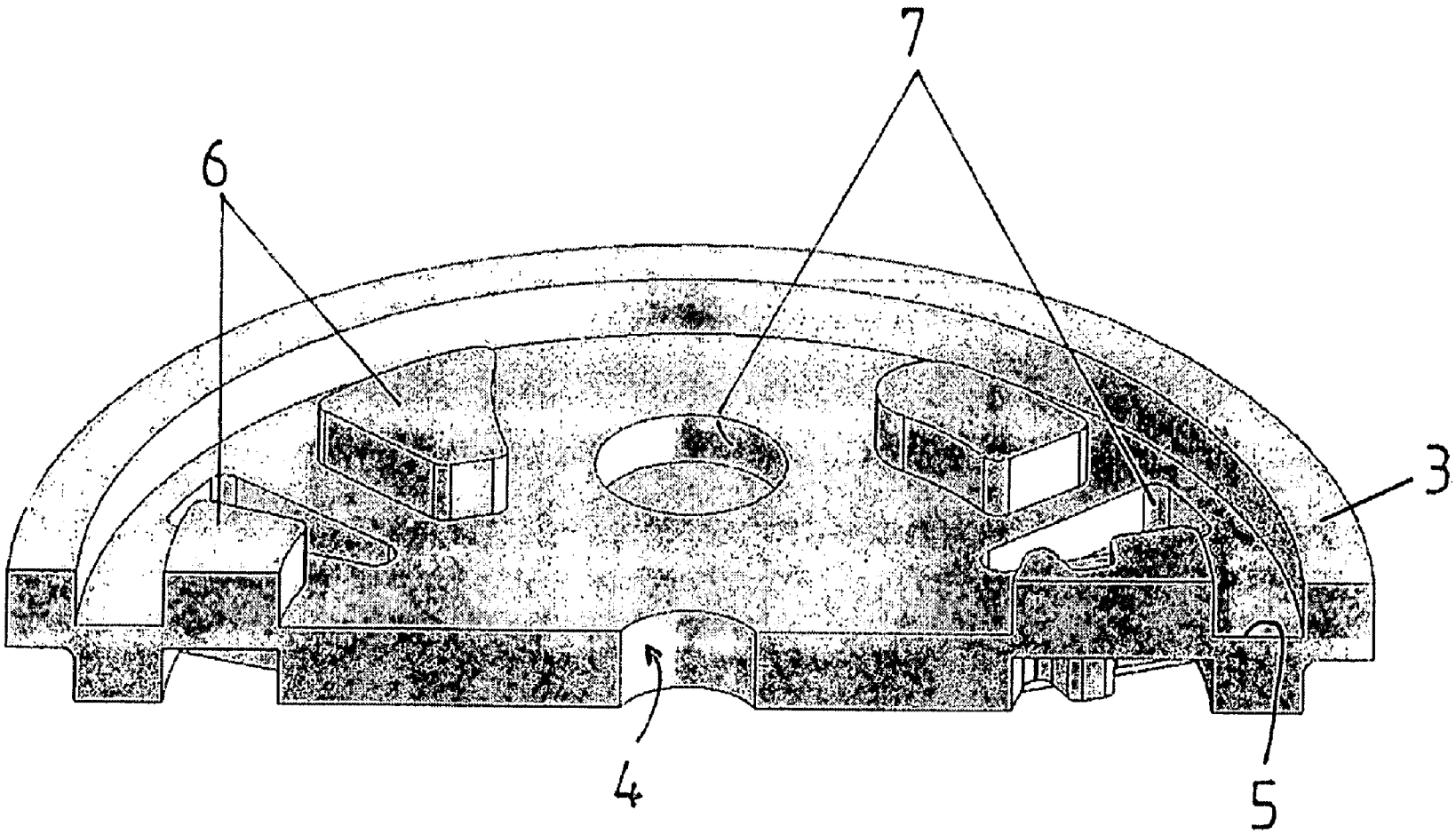
FIG. 2 is a sectional view along line B-B in FIG. 1.

With the method according to the invention, mountable, three-dimensional hinge attachments 1 for car seat components are producible in only two process steps without finishing. FIGS. 1 and 2 show a circular hinge attachment 1, which was produced from flat steel strip 2 with a thickness of 4 mm by a combination of 5 fine blanking and forming. While circular in the example, the hinge attachment 1 is not limited to such geometric shape. In the mountable condition, the hinge attachment 1 has a circular edge 3, a central hole 4 for inserting an axle (not shown) along a hinge axis A, a flat seating 5 adjacent to the inner side of edge 3, projections 6, and four projected recesses 7, which serve for the connection at the frame of the back of the seat, for example by welding.

Figure 3:
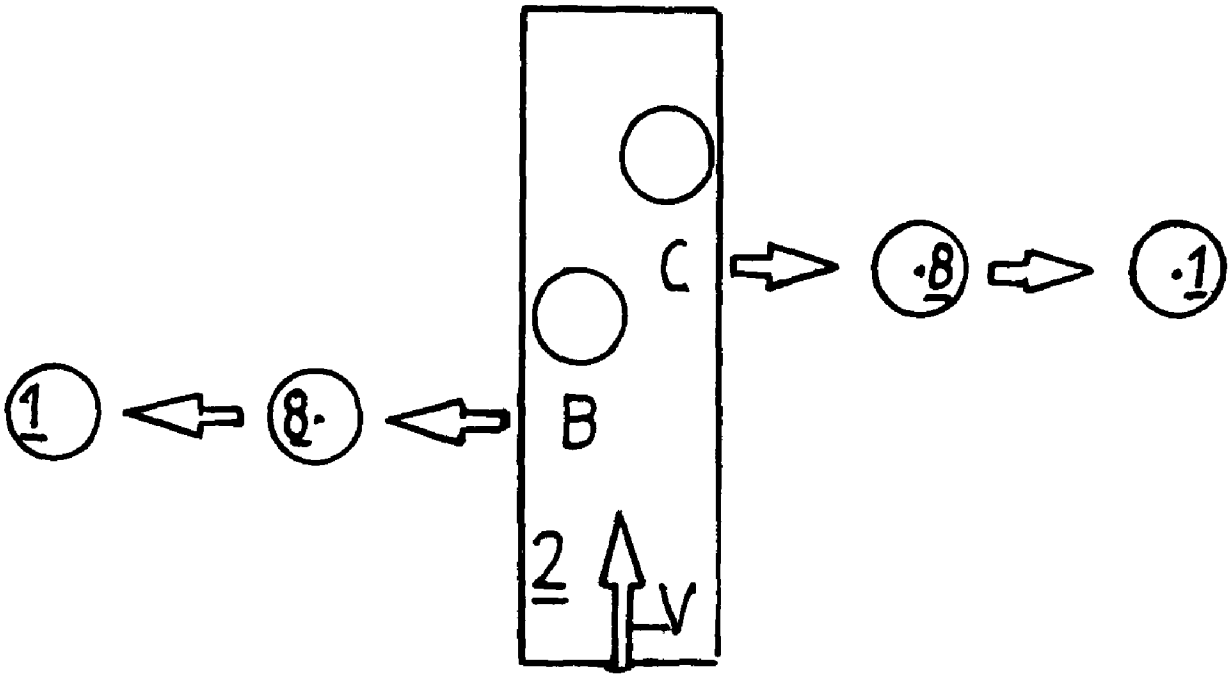
FIG. 3 is a schematic view of the method according to this invention.

The method according to the invention, as shown in FIG. 3, is executed in two process steps, namely in a first forming and fine blanking stage I, in which a complete forming and fine blanking operation takes place, in the course of which the plate 8 is formed and completely cut out of the flat strip 2, and a separate centering and flattening stage II, in which the burr 9 that developed during fine blanking is flattened directly at the tool.

Figure 4A:
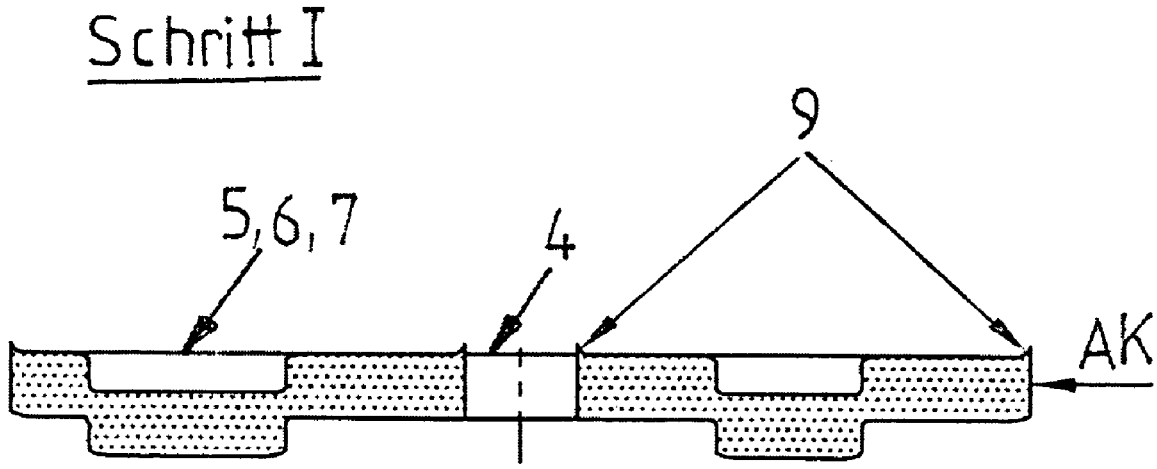
FIGS. 4*a* and 4*b* each is a principle view of the sequence of the single working operations according to FIG. 3.
Figure 4B:
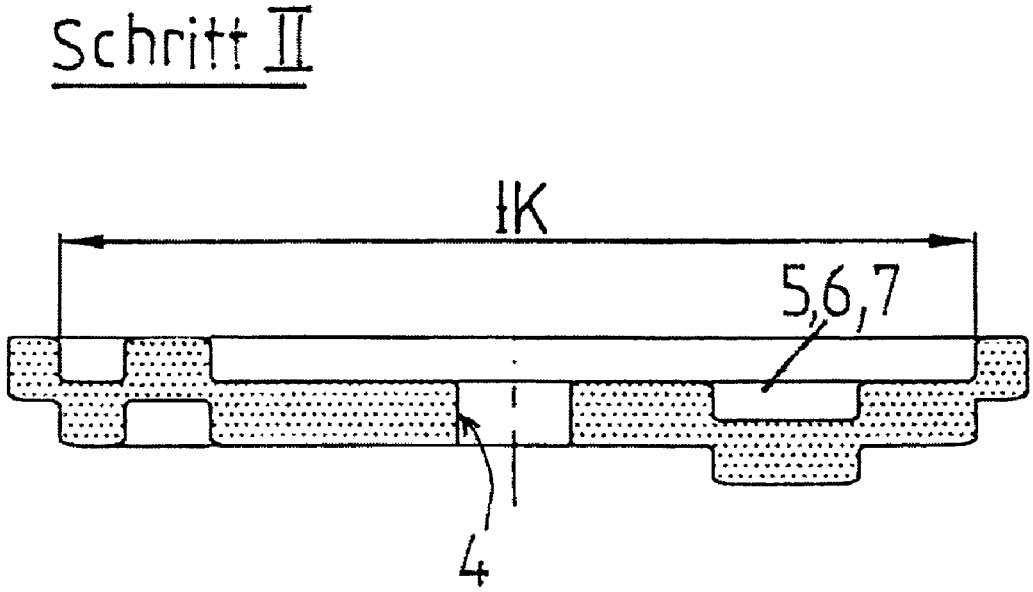

The burr 9 develops during fine blanking at the upper edge of the outer contour AK of the plate 8 and at the upper edge of the inner contour IK of hole 4 (see FIG. 4). While the impressed seating 5, the sink 6 and the indentations 7 are produced only by forming processes, which to large extent are executed simultaneously with the fine blanking operation, the position, form and location of the inner forms created during forming are aligned to the position of the diameter of the outer contour AK of the plate during complete cutting out. In other words, the diameter of the outer contour AK of the complete cut determines the execution of the forming operations to create the inner forms which ensures that the precision forming does not lead to an impairment of the outer contour AK and thus to the impairment of the tolerances or even to a distortion.

Thus the location of the impression (seating 5), the sink 6 and the indentations 7, and the hole 4, expressed in the dimension of the inner diameter IK of the inner contour, in relation to the outer contour AK is exactly defined, because the forming processes of impression, sinking and indenting can be executed approximately at the same time as the fine blanking in a common process stage.

After the plate 8 in stage I is completely cut out of the flat strip 2, a displacement of the plate 8 by the flat strip 2 can no longer take place. Thus tilts or other sources of errors as distortion or lacking circularity are excluded.

The plate 8, before flattening the developed burr 9, is centered according to its outer contour AK, and at the same time oriented according to location and form of the inner forms of the plate.

Figure 5:
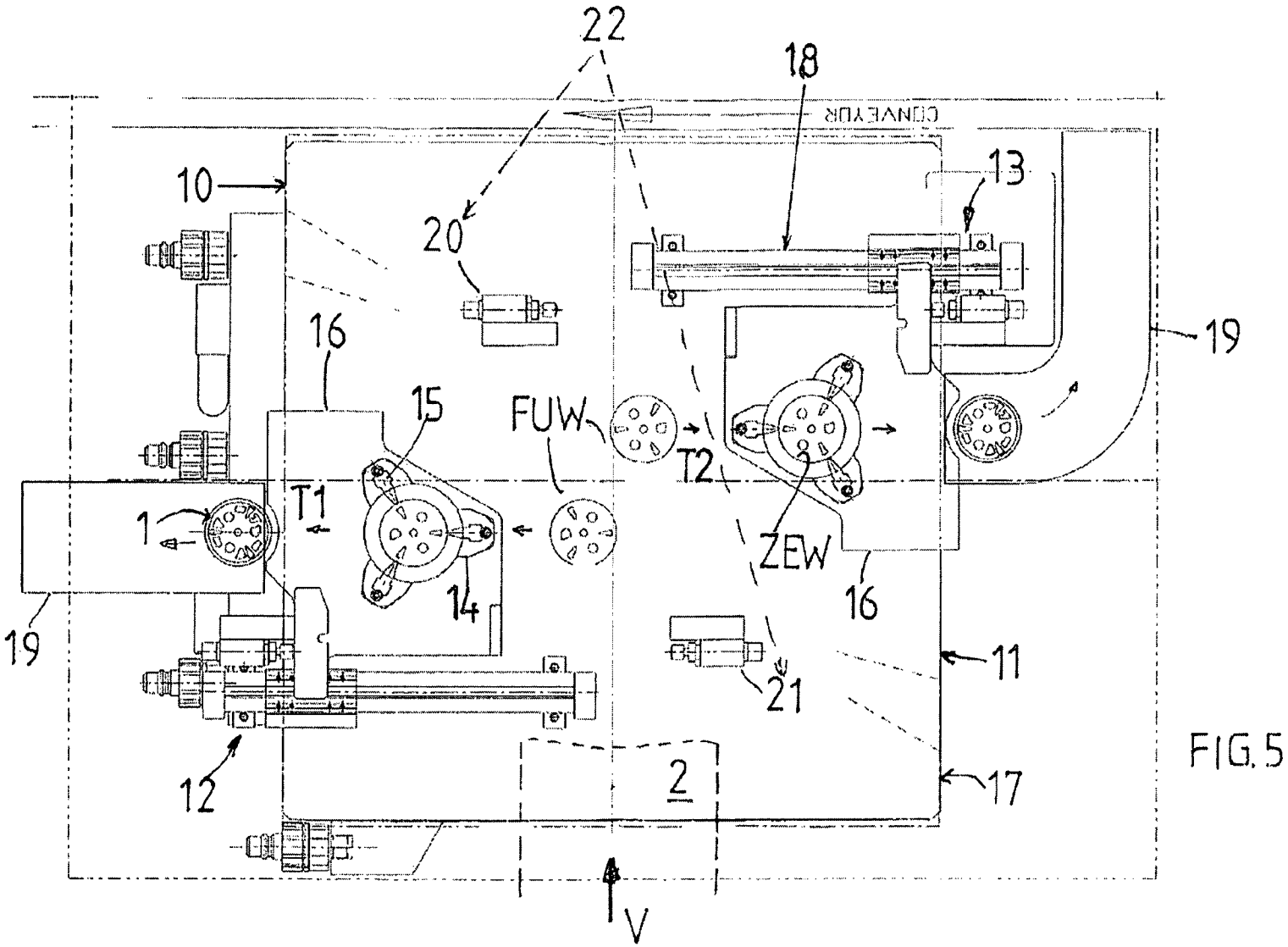
FIG. 5 is a top view of two modularly connected tools for the execution of the method according to the invention.

FIG. 5 shows two press tool modules 10 and 11 positioned side by side, with which the method according to this invention is executed. Each tool module 10 and 11 has one combined forming and fine blanking tool FUW and one separate centering and flattening tool ZEW. The tools FUW and ZEW are coupled by one transfer device 12 and 13, respectively.

The transfer devices 12 and 13, after forming and fine blanking, convey the plate 8 from tool FUW to tool ZEW, in which the plate 8 before the burr flattening is taken by a centering and orienting device 14. The centering and orienting device 14 in this example has three staggered centering fingers 15, which contact the outer contour AK of the plate 8 under an angle of 120°, so that the impression (seating 5), the sink 6 and the indentations 7 of the plate 8 in relation to their position to hole 4 are exactly fixed. The fingers 15 also make it possible to align the inner forms in a way that the flattening tool of tool ZEW is engaged at the edge of the outer contour AK and at the edge of the inner contour IK and the burr 9 can be flattened directly at the tool.

Each of the transfer devices 12 and 13 has an identical design and has a flat tappet 16, which is arranged movable alongside a shaft 18, which runs in bearings mounted on the base plate 17 of the tool module 10 and 11. The tappet 16, after fine blanking and forming in tool FUW, conveys plate 8 to tool ZEW for centering, orienting and flattening and from there the mountable hinge attachment 1 to a removing device 19 attached to tool module 10 or 11, so that each finished hinge attachment 1 can leave the press without damage.

A conveying roll 20 or 21 is mounted on each base plate 17 of the tool module 10 or 11 for feeding the flat strip 2 to the forming and fine blanking tools FUW. These conveying rolls 20 and 21 together complete a common transfer device 22 for both modules as soon as the tool module 11 is attached to the tool module 10. The tool modules 10 and 11 are therein aligned in such a way, that both forming and fine blanking tools FUW of the tool modules 10 or 11 can jointly take at the time one portion of the flat strip 2 in its feeding direction V at staggered places B and C. This leads to an even load on the flat strip 2 during the fine blanking and forming process and simultaneously makes it possible to remove the cut out and formed plates 8 in transfer directions T1 and T2 opposite to each other in direction to the outer side away from the forming and fine blanking tools FUW to the tool ZEW and further to the removing device 19 to let them out without damage.

LIST OF DRAWING REFERENCES hinge attachment 1
flat strip 2
circular edge of 1 3
hole in 1 4
impressed seating 5
sink 6
indentations 7
plate 8
burr 9
tool module 10, 11
transfer device 12, 13
centering and orienting device 14
centering finger 15
tappet 16
base plate of 10, 11 17
shaft 18
removing device 19
conveying roll 20, 21
transfer device 22
axle A
forming and fine blanking stage (step I) I
centering and flattening stage (step II) II
dimension—outer contour AK
engaging places B, C
dimension—inner contour IK
fine blanking and forming tool FUW
centering and flattening tool ZEW
transfer directions T1, T2
feeding directions of flat strip 2 V

The invention claimed is:

1. A method for producing three-dimensional attachments out of a flat strip, comprising:

feeding in a feeding direction the flat strip into a first press tool;

at the first press tool, executing at approximately a same time both a fine blanking operation to completely cut out a workpiece from the flat strip giving the cut out workpiece an outer contour and a forming operation for reshaping the workpiece so that a first side of the workpiece has said outer contour at a first height, an adjacent flat seating recessed from the first height, and at least one inner form having a height different than that of the flat seating, a first inner form of the at least one inner form including any of a projection or indentation contoured relative to the flat seating, wherein the outer contour is not deformed during said reshaping and orients the reshaping so that the at least one inner form is precisely located with reference to the outer contour, thereby avoiding distortion and impaired tolerances of the at least one inner form;

conveying the workpiece into a second press tool; and at the second press tool, pressing into the workpiece burrs developed at least at the outer contour during cutting out of the flat strip, said workpiece being centered according to said outer contour and simultaneously oriented according to location of the at least one inner form which was formed into the workpiece, such that the burrs of the fine blanked surfaces are flattened directly in the second press tool, whereby a three-dimensional attachment is formed from the flat strip; and wherein said executing a fine blanking operation comprises completely cutting out a workpiece from the flat strip to provide the cut out workpiece with said outer contour, said outer contour being completely cut out of the flat strip to define an entire outer peripheral edge of the workpiece.

2. A method according to claim 1, wherein the attachment is removed from the second tool after said flattening, the attachment being ready for use without performing additional finishing steps.

3. A method according to claim 1, wherein said at least one inner form includes at least one selected from a group consisting of impressions, projections, indentations, recesses, sinks, and pivots.

4. A method according to claim 1, wherein;

said executing is performed simultaneously at each of at least two identically designed first press tools at staggered places in the feeding direction of the flat strip;

said flattening is performed at each of at least two identically designed second press tools; and finished three-dimensional attachments are removed after completion of the flattening from the respective second press tools along different transfer directions.

5. A method according to claim 1, wherein said executing is performed at an axial place of the flat strip in the feeding direction of the flat strip, and the three-dimensional attachment is removed from the second press tool after flattening in a transfer direction substantially perpendicular to the feeding direction of the flat strip.

6. A method according to claim 1, wherein locations of the first press tool and second press tool are coupled by a transfer device which moves the workpiece from the first press tool to the second press tool.

7. A method according to claim 1, wherein centering of the workpiece according to the outer contour thereof is executed by centering and orienting devices evenly engaging said outer contour.

8. A method according to claim 1, wherein at the first press tool said workpiece is cut from the flat strip with said outer contour having a substantially circular or evenly curved contour.

9. A method for producing three-dimensional attachments out of a flat strip, comprising;

commonly feeding the flat strip in a feeding direction into respective first press tools of first and second press tool modules;

at the first press tool of the first press tool module, executing at approximately a same time both a fine blanking operation to completely cut out a first workpiece from the flat strip giving the cut out first workpiece an outer contour and a forming operation for reshaping the first workpiece so that a first side of the first workpiece has said outer contour at a first height, an adjacent flat seating recessed from the first height, and at least one inner form having a height different than that of the flat seating, a first inner form of the at least one inner form including any of a projection or indentation contoured relative to the flat seating; wherein the outer contour is not deformed during said reshaping and orients the reshaping so that the at least one inner form is precisely located with reference to the outer contour, thereby avoiding distortion and impaired tolerances of the at least one inner form;

at the first press tool of the second press tool module, executing at approximately a same time both a fine blanking operation to completely cut out a second workpiece from the flat strip giving the cut out second workpiece an outer contour and a forming operation for reshaping the second workpiece so that a first side of the second workpiece has said outer contour at a second height, an adjacent flat seating recessed from the second height, and at least one second workpiece inner form having a height different than that of the flat seating, a second inner form of the at least one second workpiece inner form including any of a projection or indentation contoured relative to the flat seating; wherein the second workpiece outer contour is not deformed during said reshaping and orients the reshaping so that the at least one second workpiece inner form is precisely located with reference to the second workpiece outer contour, thereby avoiding distortion and impaired tolerances of the at least one second workpiece inner form;

feeding the first workpiece to a second press tool of the first press tool module;

feeding the second workpiece to a second press tool of the second press tool module;

at the second press tool of the first press tool module, pressing into the first workpiece burrs developed at least at the outer contour of the first workpiece during cutting out of the flat strip, the first workpiece being centered according to the first workpiece's outer contour and simultaneously oriented according to location of the first workpiece's at least one inner form, such that the burrs of the fine blanked surfaces are flattened directly in the second press tool of the first press tool module, whereby a first three-dimensional attachment is formed from the flat strip;

at the second press tool of the second press tool module, pressing into the second workpiece burrs developed at least at the outer contour of the second workpiece during cutting out of the flat strip, the second workpiece being centered according to the second workpiece's outer contour and simultaneously oriented according to the location of the second workpiece's at least one inner form, such that the burrs of the fine blanked surfaces are flattened directly in the second press tool of the second press tool module, whereby a second three-dimensional attachment is formed from the flat strip wherein said executing a free blanking operation, comprises completely cutting out a workpiece from the flat strip to provide the cut out workpiece with said outer contour, said outer contour being completely cut out of the flat strip to define an entire outer peripheral edge of the workpiece.

10. A method for producing three-dimensional attachments out of a flat strip with a 2-step tool module having a first press tool and a second press tool, comprising:

feeding in a feeding direction the flat strip into the first press tool;

at the first press tool, executing at approximately a same time both a fine blanking operation to completely cut out a workpiece from the flat strip giving the cut out workpiece an outer contour and a forming operation for reshaping the workpiece so that a first side of the workpiece has said outer contour at a first height, an adjacent flat seating recessed from the first height, and at least one inner form having a height different than that of the flat seating, a first inner form of the at least one inner form including any of a projection or indentation contoured relative to the flat seating, wherein the outer contour is not deformed during said reshaping and orients the reshaping so that the at least one inner form is precisely located with reference to the outer contour, thereby avoiding distortion and impaired tolerances of the at least one inner form;

conveying the workpiece within the 2-step tool module from the first press tool to the second press tool;

at the second press tool, pressing into the workpiece burrs developed at least at the outer contour during cutting out of the flat strip, said workpiece being centered according to said outer contour and simultaneously oriented according to location of the at least one inner form which was formed into the workpiece, such that the burrs of the fine blanked surfaces are flattened directly in the first press tool, whereby a three-dimensional attachment is formed from the flat strip wherein said executing a free blanking operation, comprises completely cutting out a workpiece from the flat strip to provide the cut out workpiece with said outer contour, said outer contour being completely cut out of the flat strip to define an entire outer peripheral edge of the workpiece.

11. A method according to claim 9, wherein for each one of the first press tool of the first press tool module and the first press tool of the second press tool module, said executing a fine blanking operation comprises completely cutting out the corresponding first or second workpiece from the flat strip to provide the cut out workpiece with said outer contour, said outer contour being completely cut out of the flat strip to define an entire outer peripheral edge of the corresponding first or second workpiece.

12. A method for producing three-dimensional attachments out of a flat strip, comprising:

feeding in a feeding direction the flat strip into a first press tool;

at the first press tool, executing at approximately a same time both a fine blanking operation to completely cut out a workpiece from the flat strip giving the cut out workpiece an outer contour and a forming operation for reshaping the workpiece so that a first side of the workpiece has said outer contour at a first height, an adjacent flat seating recessed from the first height, and at least one inner form having a height different than that of the flat seating, a first inner form of the at least one inner form including any of a projection or indentation contoured relative to the flat seating, wherein the outer contour is not deformed during said reshaping and orients the reshaping so that the at least one inner form is precisely located with reference to the outer contour, thereby avoiding distortion and impaired tolerances of the at least one inner form;

conveying the workpiece into a second press tool; and at the second press tool, pressing into the workpiece burrs developed at least at the outer contour during cutting out of the flat strip, said workpiece being centered according to said outer contour and simultaneously oriented according to location of the at least one inner form which was formed into the workpiece, such that the burrs of the fine blanked surfaces are flattened directly in the second press tool, whereby a three-dimensional attachment is formed from the flat strip wherein said executing a free blanking operation, comprises completely cutting out a workpiece from the flat strip to provide the cut out workpiece with said outer contour, said outer contour being completely cut out of the flat strip to define an entire outer peripheral edge of the workpiece.

* * * * *